US008713740B2

(12) United States Patent
Mann

(10) Patent No.: US 8,713,740 B2
(45) Date of Patent: May 6, 2014

(54) CLEANING SYSTEM AND METHOD

(75) Inventor: Aviram Mann, Modiín (IL)

(73) Assignee: Aviram Mann, Modiin (IL)

( * ) Notice: Subject to any disclaimer, the term of this patent is extended or adjusted under 35 U.S.C. 154(b) by 642 days.

(21) Appl. No.: 12/736,016

(22) PCT Filed: Mar. 16, 2009

(86) PCT No.: PCT/IL2009/000294
§ 371 (c)(1),
(2), (4) Date: Sep. 1, 2010

(87) PCT Pub. No.: WO2009/116031
PCT Pub. Date: Sep. 24, 2009

(65) Prior Publication Data

US 2010/0325821 A1 Dec. 30, 2010

(30) Foreign Application Priority Data

Mar. 19, 2008 (IL) ..... 190299

(51) Int. Cl.
*A47L 1/02* (2006.01)

(52) U.S. Cl.
USPC ..... 15/103; 15/49.1; 15/50.1

(58) Field of Classification Search
USPC ..... 15/21.1, 49.1, 50.1, 98, 250.11, 103
See application file for complete search history.

(56) References Cited

U.S. PATENT DOCUMENTS

| | | | | |
|---|---|---|---|---|
| 379,875 | A * | 3/1888 | Nash | 15/80 |
| 3,001,218 | A * | 9/1961 | Tarney | 15/103 |
| 3,643,281 | A * | 2/1972 | Schofield | 15/181 |
| 7,231,683 | B1 * | 6/2007 | Cruz | 15/103 |
| 7,503,091 | B2 * | 3/2009 | White et al. | 15/103 |
| 7,665,173 | B2 * | 2/2010 | Simonette et al. | 15/50.3 |
| 2004/0084062 | A1 * | 5/2004 | Theiss et al. | 134/6 |
| 2006/0096050 | A1 * | 5/2006 | Simonette et al. | 15/103 |
| 2007/0174982 | A1 * | 8/2007 | Lin | 15/77 |

FOREIGN PATENT DOCUMENTS

JP 04102421 A * 4/1992 ..... A47L 1/02

* cited by examiner

*Primary Examiner* — Monica Carter
*Assistant Examiner* — Michael Jennings

(57) ABSTRACT

A system for cleaning windows in tall buildings, comprises a chassis (7) with means for its mounting on a suspended platform. (3) It also includes a rotating conveyor belt (61) mounted on the chassis and brushes (62) mounted on the conveyor belt. Each brush is mounted through extender means (63). Preferably, the conveyor belt includes means for its rotation in a generally horizontal direction. The means for rotating the conveyor belt include a first roller (71) and a second roller (72) mounted on the chassis. The conveyor belt is preferably mounted between the rollers and further includes motor means for rotating one of the rollers.

9 Claims, 8 Drawing Sheets

CLEANING SYSTEM AND METHOD

The present application claims priority from the patent application No. 190299 filed in Israel on 19.3.2008 by the present applicant and having the same title.

TECHNICAL FIELD

The present relates to a system for cleaning windows in tall buildings, and especially suitable for work at high locations.

BACKGROUND ART

At present, there is a problem of cleaning windows and walls of tall buildings. The work is expensive, labor-intensive and may be hazardous. The weather has to be considered as well. When there are strong winds, such work may be still more difficult.

Sometimes a scaffolding has to be erected.

An irregular-shaped building may be still more difficult to clean.

A working platform may be located external to the building and in close proximity thereto. The platform may be moved vertically and horizontally, to gain access to all the windows and places to be cleaned there.

Still, there remains the problem of suitable automatic means for doing the cleaning work itself—the present invention is concerned with replacing manual labor with a remotely controlled system.

The task is not simple: Windows may have protuberances located in their upper part or the lower part, etc. Access may be difficult.

Usually, in tall buildings the windows/walls structure pertains to one of the following types:

A. The window may have a frame which is flat or vertical, of a size of about 0 to 5 cm, in some instances possibly more.

B. Other windows may have flat vertical frames of about 2 to 5 cm, and horizontal frames (window-sill or ledge) which protrude out of the window plane by about 3 cm, and of a width of about 2 to 5 cm.

Balustrades or horizontal frames may protrude out up to 30 cm off the surface of the window or wall.

In walls having a large window (picture window) the structure of the windows frame is usually of the type A or B.

Preferably, the platform with the cleaning means thereon will be moved vertically at a constant rate during the cleaning process. Buildings, however, usually have horizontal ledges or other protuberances which may interfere with the continuous operation of the cleaning means.

DISCLOSURE OF INVENTION

The present invention relates to cleaning means which may be mounted on a suspended platform; the platform has a capability of moving in space, under remote control.

The novel cleaning means achieve an effective cleaning of the windows and walls, despite the frames which may be found around the windows, and other protuberances including horizontal ledges.

A novel structure addresses the special problems related to the cleaning and polishing processes, for example:

Problem: To reach the window, it may be necessary to bridge a horizontal distance of about 20-30 cm from the conveyor for horizontal irregularities, wherein the movement is linear lengthwise, and so as not to affect the brush at the end of the conveyor.

A brush of such a length has to be very stiff in order to be able to clean, a property which, however, may cause damage to delicate frames, or scratches to the window and may not allow polishing.

Solution: Strong but elastic extenders are used to attach the brushes to the conveyor belt. Easily replaceable belt allow to use a belt with extenders and brushes which are best suited for each specific job, either for cleaning or polishing. The novel structure allows it both to pass within the long vertical window-frames and to clean the window with its short dense ends or with polishing heads.

The system may use brushes attached to either a conveyor or to several thin belts running in parallel.

Problem: During the linear lengthwise movement of the brushes over the flat horizontal window-frame there is an area which is not cleaned (dead area) at the drop from the frame to the window surface.

Solution: Using a structure including two conveyors, one mounted above the other and rotating in opposite directions. Each one of the conveyors will effectively clean the dead area of the other.

Problem: Let us assume the device is moving continuously up along the building wall, wherein the brush starts above or below the protruding window-sill and rises diagonally because of the combined velocities, Up for the whole device and Horizontally for the conveyor. The angle of the slant movement depends on the horizontal and vertical component velocities in use. This may cause the brush and/or its extender to scratch the end of the frame.

Solution: Change the inclination angle (relative to horizontal) of the movement of the conveyor according to the above detailed horizontal and vertical velocities, so the total actual movement of the brushes is horizontal. Horizontal movement—of the belt; Vertical movement—of the device along the building.

A brush starting to clean inside the frame will remain there for the duration of one sweep; the same if the brush starts above or below a window-sill.

Furthermore, a motor controlled by the control unit may be used, to change the angle of the conveyor in case the horizontal and/or vertical velocities are changed.

The angle has to be changed as the device changes direction (from up to down or vice versa). The angle may be changed for example from slanting up to the right side of the device, to slanting up to the left, at the same angle.

The platform may be used in a device for cleaning windows and building facades using brushes, polishing means and means for washing the brushes with water.

One goal of the invention is to perform various tasks at elevated locations, such as the side of a building, without endangering workers, using a platform which is movable in space.

One embodiment of the invention comprises a device suspended on a cable from a crane located at the top of the building.

The cable includes mechanical support means, together with a supply of electricity, water, communications, etc.

The device may be controlled from a remote, safe location.

BEST MODE FOR CARRYING OUT THE INVENTION

Figure 1:
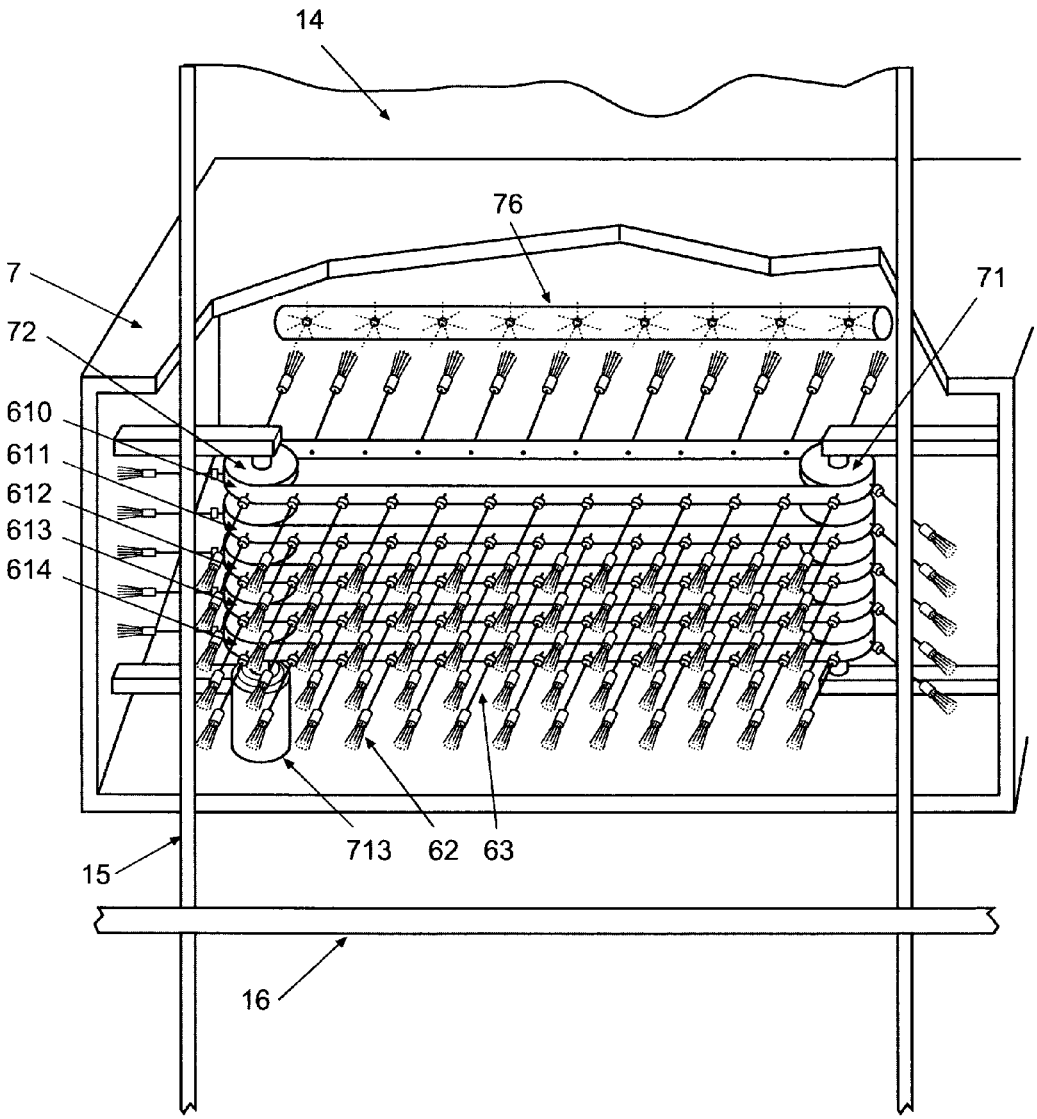
FIG. 1 illustrates a perspective view of the cleaning system with its rotating stripes and the brushes mounted on them

FIG. 1 illustrates a perspective view of a preferred embodiment of the cleaning system. The system may include either a rotating conveyor belt 61 (see FIG. 3) or a group of parallel rotating stripes 610, 611, 612, 613, 614 . . . mounted on the chassis.

Cleaning heads 62 may each be mounted on the belt 61 or the stripes 610 . . . through a flexible extender 63.

A cleaning head 62 may include a brush, a polishing head or a wiper, etc.

Wipers may be used to remove the water, when water washing is used with the nozzles 76 spraying water on the windows, for example.

A window 14 in a building to be cleaned, may possibly have a protruding vertical frame or ledge 15 and/or horizontal window-sill 16.

The new cleaning system may include a chassis 7 mounted on a suspended platform 3 (see FIG. 2), with a first roller 71 and a second roller 72 for rotating the stripes 610, 611 . . . . A motor 713 may drive the first roller 71.

The new cleaning system can be used with a platform which moves continuously in a vertical direction, up or down along the external surface of the building.

In another embodiment, the cleaning system and the platform may move along a horizontal or a vertical path, according to the requirements of the surface to be cleaned.

The new cleaning system uses brushes with a horizontal movement, which achieve a satisfactory level of cleaning, despite the presence of the abovementioned ledges and irregularities; there is no need to stop the movement of the platform because of the ledges; the new system will not exert a significant vertical force on these ledges.

The structure of the system is such as to allow the new cleaning heads or brushes a horizontal movement along one or more windows, wherein the brushes move over the flat vertical window-frames and between the protruding vertical ledges.

Figure 2:
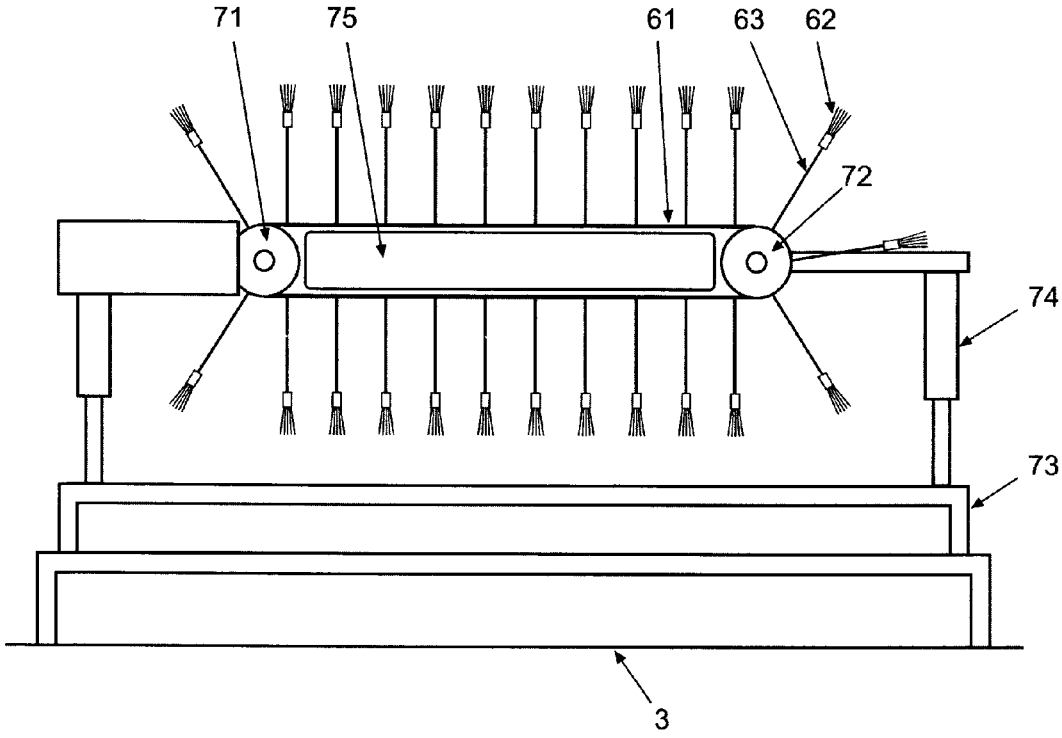
FIG. 2 illustrates a top view of the cleaning system

FIG. 2 illustrates a top view of the cleaning system, including a suspended stabilized platform 3, a mechanism for changing the conveyor's angle 73, shock absorbers 74, a support surface 75.

System Components a. chassis 7 b. conveyor with conveyor belt 61 and rollers 71 and 72, motor 713 c. extenders 63 and cleaning heads or brushes 62 d. the washing and pumping sub-system e. conveyor positioning arm f. command and control means g. support means which preserve the extenders 63 in a generally horizontal orientation, against the force of gravity which pulls the cleaning heads 62 down.

a. the chassis 7 is preferably made of light and strong materials; it is attached to the platform using screws, for example, or quick-release means, to allow easy mounting or dismounting of the chassis. A specific chassis 7 may be selected as may be suitable to the task at hand. The chassis may include one or more conveyors, as required.

The conveyors mounted on the chassis 7 may include motors and the guiding sub-system for the vertical movement, for the adjustment of the linear movement of the conveyor.

The chassis 7 may further include means for the mounting of nozzles or jets for washing thereon 76, and a suction sub-system for pumping away the remaining water after the washing.

The command and control box, which is connected to the system controller, may also be mounted on the chassis.

b. the conveyor comprises two cylinders 71 and 72, one of them (71) being rotated by a motor 713, the other (72)—through a tension wheel.

A belt 61 is mounted between the two cylinders; its velocity is determined by that of the driving wheel 71.

Rather than a belt 61, the system may use thin stripes 610 . . . or a chain.

Extender means 63, mounted on the belt 61, hold the cleaning brushes 62. The belt 61 is moved along a guide 75 (FIG. 2) which supports it against the force exerted by the brushes 62 upon the belt 61. Thus the belt's deformation is minimal, even though the brushes attached thereon apply a pressure upon the surface to be cleaned.

Using the command and control means, it is possible to control the velocity of the belt 61.

Figure 3:
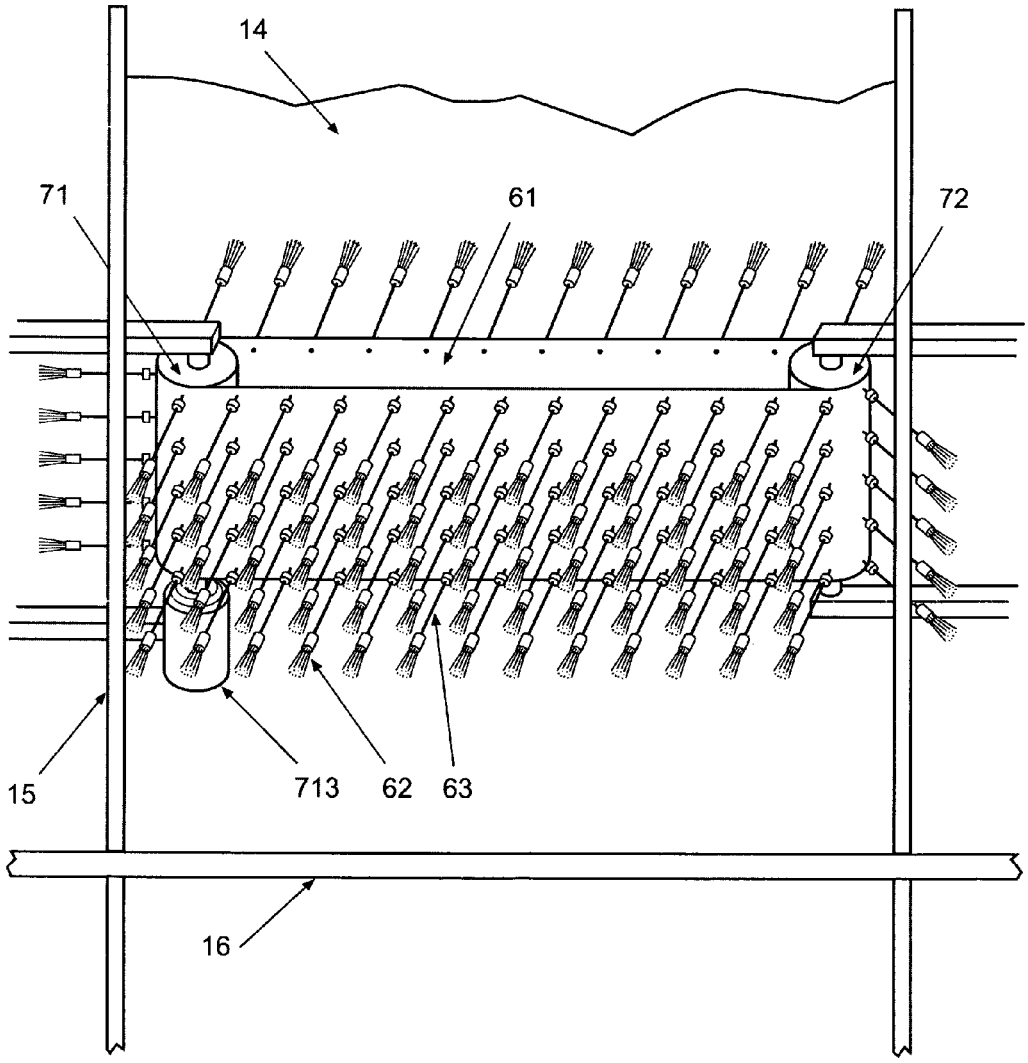
FIG. 3 illustrates another perspective view of the cleaning system with its rotating conveyor belt FIG. 4 details a roller with stripes and cleaning heads thereon FIGS. 5A, 5B, 5C and 5D detail various window-frame shapes FIGS. 6A, 6B and 6C detail a slant conveyor belt for compensating for the platform's vertical movement, and a dual belt conveyor FIG. 7 details the flexibly mounted cleaning head 62, as it adapts to a ridge in the surface being cleaned.

The length of the belt 61 determines the extent of movement of the brushes 62 attached to it, therefore the width of the surface being cleaned as the platform moves up or down the surface of the building (see FIG. 3).

c. the extenders 63 and cleaning heads 62, which are mounted on the belt 61, are preferably built from a material having a controlled measure of rigidity/flexibility. This property may be achieved for example using a spring having a predefined K factor, derived for example from its dimensions and the materials used. A thin, long spring may be more flexible than a short, thick spring; the type of steel is also a factor. Other materials may be used as well, for example plastics, as known in the art.

This rigidity/flexibility feature will be so determined to allow the brushes or cleaning heads 62 with their extenders 63 to follow the shape of the window's frame and ledges on its margins. The length of the extenders 63 may be determined by the height (the measure of protrusion out of the surface of the window) of the window's frame 15 and ledges 16, see FIGS. 5A, 5B, 5C and 5D.

Ball bearings 634 (see FIG. 4) on the extenders 63 may roll over the support means 636.

Thus, for each type of wall and windows, a suitable belt 61 with extenders 63 and brushes 62 will be mounted on the conveyor. The length of the extenders 63 and the rigidity/flexibility of the extenders will be so determined as to effectively adapt to the shape of the window frame and/or ledges, taking into account the sweep velocity—this may also be a factor determining the dynamics of the system.

Preferably, the extenders 63 will be covered with a soft material such as a textile or soft plastic, to prevent scratches to the building and its components.

Various cleaning heads or brushes 62 may be used according to the task at hand or the cleaning requirements, for example rough or fine cleaning, or polishing, etc. In another embodiment, the brushes 62 are replaced with wipers to remove the water, when water washing is used with the nozzles 76 spraying water on the windows.

Polishing heads made of textile or other materials may be used as well.

d. the spraying, washing and pumping sub-system

In case the brushes system will not clean to a sufficient degree, then subsequent water cleaning may be required, possibly using detergents. Water spray may be used initially, with initial cleaning with brushes, to be followed by drying the surface and further cleaning with the brushes and polishing.

In this case, there may be a conveyor with a wipers system for removing the excess water. The swipers and rough brushes may be used to remove the water to the side frame.

Over the conveyor there may be mounted a nozzles system for spraying water on the window, to dissolve the dirt which may not be removed by the brushes.

Thus, mechanical cleaning is complemented with water cleaning.

Along the side frame there will be mounted a suction head, which may be connected to a suction pump for air or water, which will remove the dirty water and will dry the window surfaces.

e. conveyor positioning arm

The conveyor is attached to the chassis 7 through an adjustable arm. The arm controls the distance between the conveyor and the system, and the pressure exerted by the device on the window.

The arm further acts as a shock absorber and to maintain a continuous, gentle pressure.

Moreover, the arm allows movement in various directions, to keep a constant pressure in all directions. These movement directions Amy include left-right, up-down and diagonally.

The structure of the arm—it may include, for example, four cylinders in the corners, in the form of shock absorbers 74 on air, wherein the air pressure controls the location of the conveyor and the pressure exerted by it, from all directions and angles.

f. command and control means

The command and control system may control:

1. the rotation rate of the conveyor's motor and its electricity consumption 2. the motor which controls the horizontal angle of the conveyor and the support means 3. the pressure of the arm structure g. support means 634 (see FIG. 4) which preserve the extenders 63 in a generally horizontal orientation, against the force of gravity which pulls the cleaning heads 62 down. Preferably, ball bearings 634 mounted on the extender 63 move along the support means 636.

Preferably, the support means 636 are located near the belt 61 or stripe 610 . . . .

Structure and Operation of the Cleaning System—Goals a. Thorough cleaning of windows or other surfaces from dirt b. Polish c. Cleaning the whole surface of the window, including the window-frames and the window areas close to the frame.

FIG. 3 illustrates another perspective view of the cleaning system, including a motor 713 driving first roller 71, brushes 62 mounted on the conveyor belt 61 through extenders 63.

Figure 4:
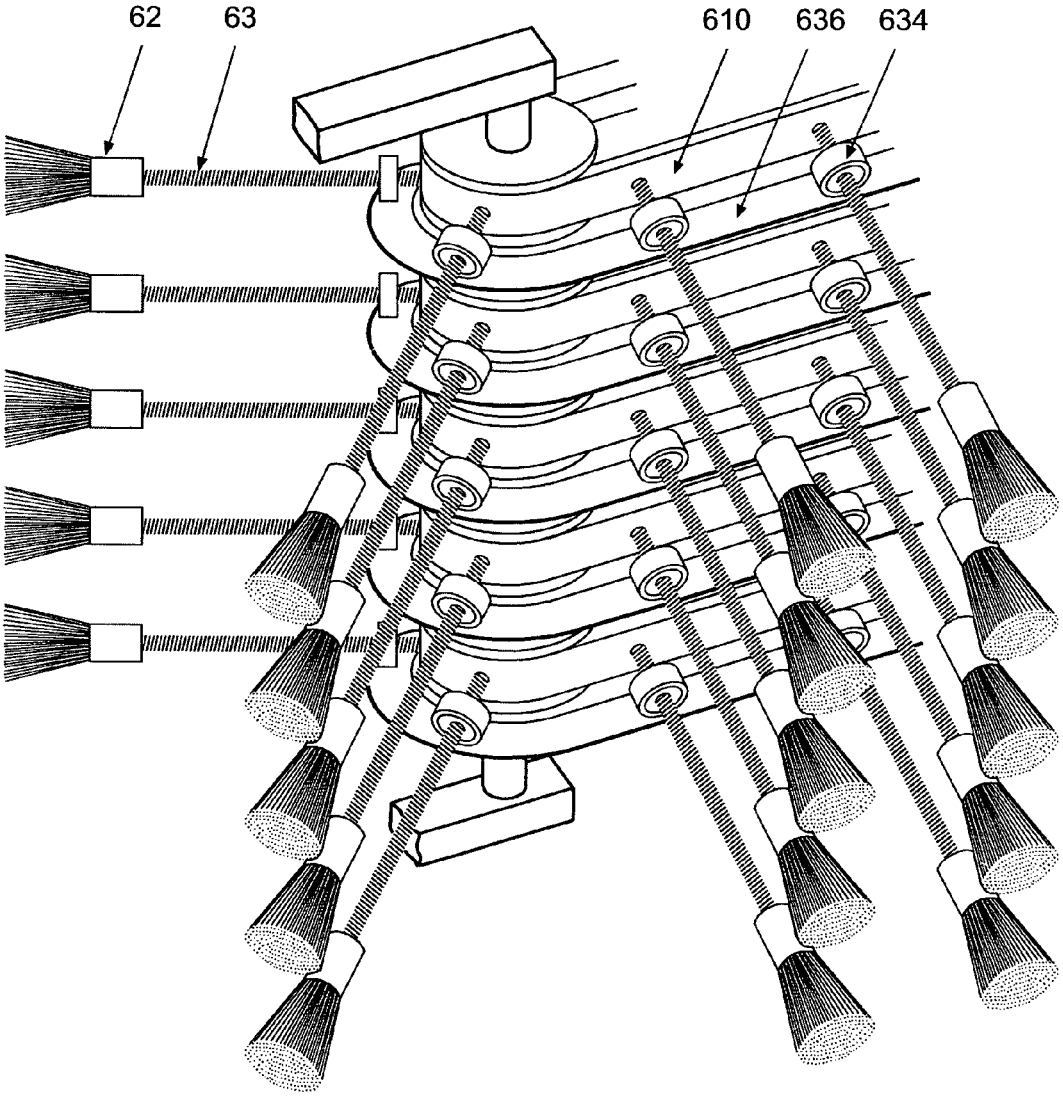
Figure 5A:
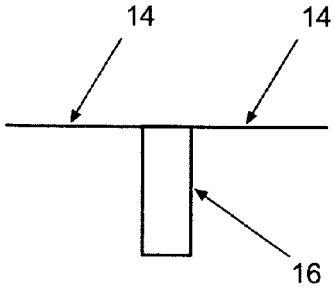
Figure 5B:
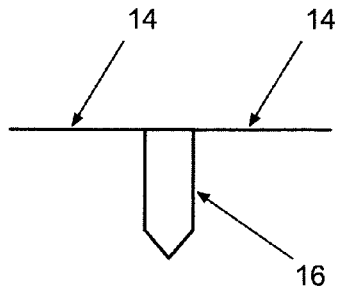
Figure 5C:
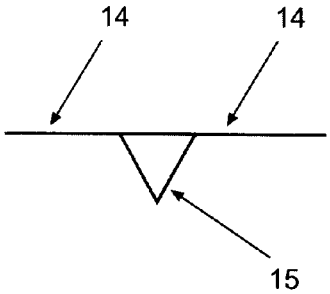
Figure 5D:
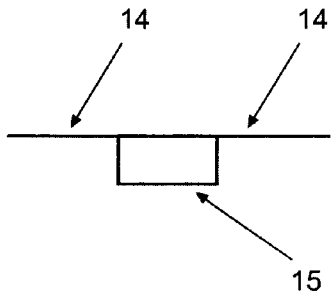

FIG. 4 details a roller with stripes 610, 611, 612 . . . thereon, and cleaning heads 62 mounted on the stripes through extenders 63.

Support means or guides 636 are mounted under the extenders 63 so that ball bearings 634 on the extenders 63 can roll thereon, that is move along the designated path with a minimum of friction, while the support means 636 keep the extenders 63 in a generally horizontal orientation.

The optional features 636 with 634 keep the cleaning heads 62 directed toward the surface to be cleaned, despite the gravity force that tends to bend the extenders 63 down. Thus is achieved a structure that is both flexible and keeps the cleaning heads horizontal.

Flexible—to adapt to irregularities in the surface to be cleaned so as to achieve a high performance cleaning.

Keeps the cleaning heads horizontal—to perform effective cleaning; the heads are most efficient when in a horizontal orientation, normal to the surface to be cleaned.

FIGS. 5A, 5B, 5C and 5D detail examples of various window-frame shapes found in building, illustrating a window 14 in a building to be cleaned, with a vertical frame or ledge 15 and/or a horizontal window-sill 16.

Figure 6A:
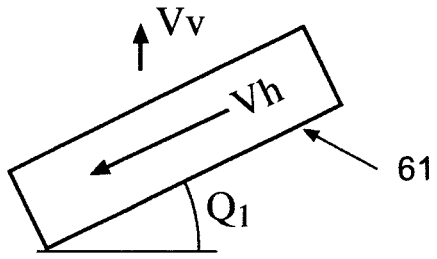

FIG. 6A details a slant conveyor belt 61 for compensating for the vertical movement of the cleaning system, up or down the building. In the example as illustrated, the conveyor belt 61 moves left but also up, so its total movement will be at a slant angle.

By setting the belt 61 at an angle Q1 as illustrated, where the angle Q1 is Q1=arcsin(Vv/Vh)

the ratio of the vertical velocity Vv to the belt's velocity Vh, the belt angle compensates for the above effect, thus the brushes will move horizontally along the surface of the wall, despite the vertical movement of the system.

Figure 6B:
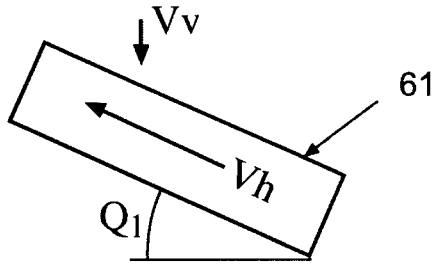

As illustrated in FIG. 6B, where the system moves down, the angle Q1 should be in the other orientation but the same value.

Figure 6C:
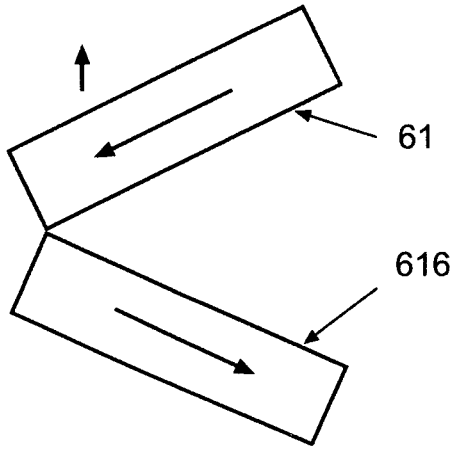

FIG. 6C details a dual belt conveyor for cleaning in the dead areas of a single belt; the two belts 61, 616 move in opposite horizontal directions to achieve this effect.

To compensate for the vertical movement of the system, the two belts are inclined at complementing slant angles as illustrated.

Figure 7:
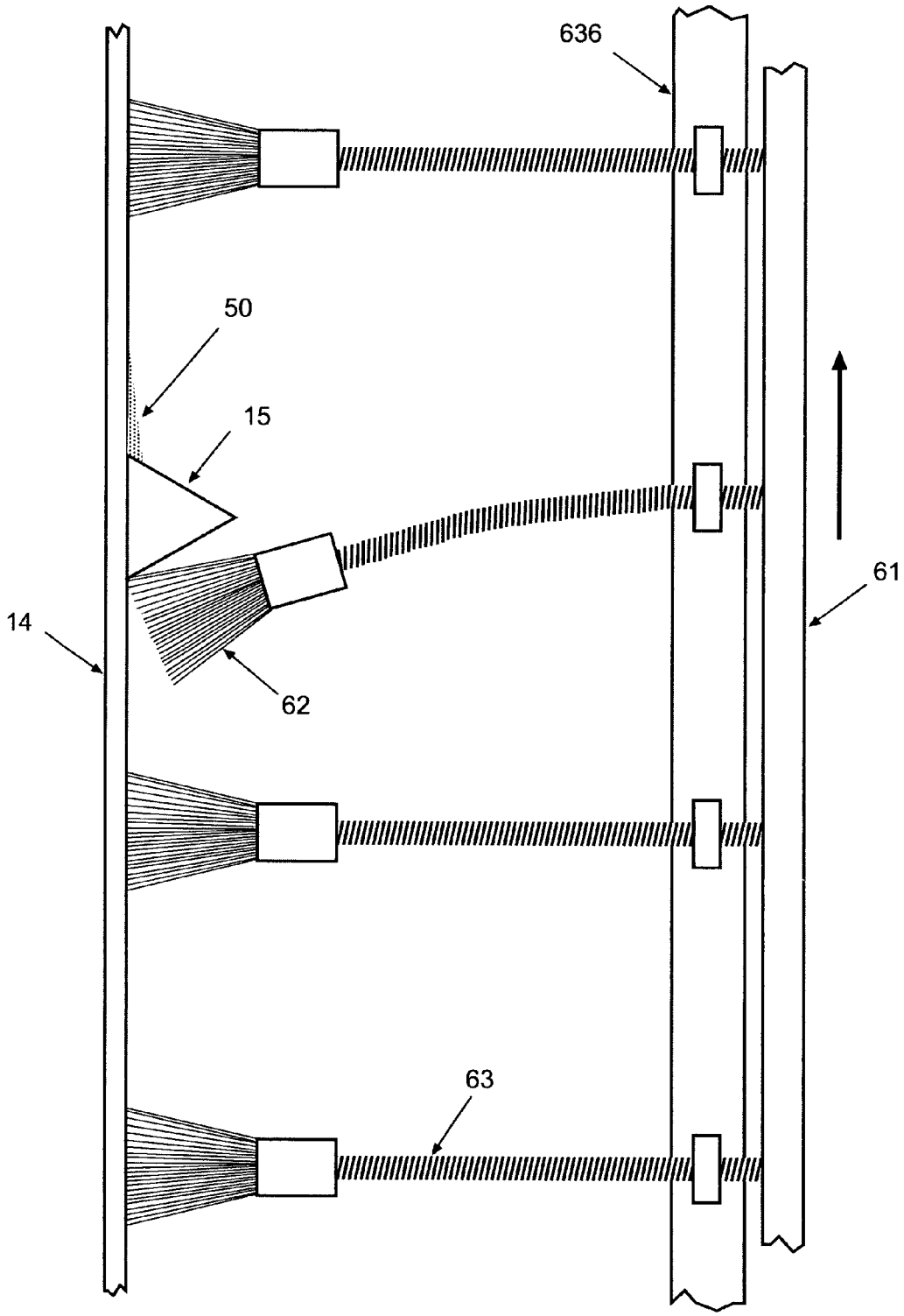

FIG. 7 details the flexibly mounted cleaning head 62, and its adaptation to various ledges 15 or frames protruding off the window's surface 14. The brushes 62 are each mounted on the conveyor belt 61 through a flexible extender 63. Dead area 50 which the brushes can't clean.

Figure 8A:
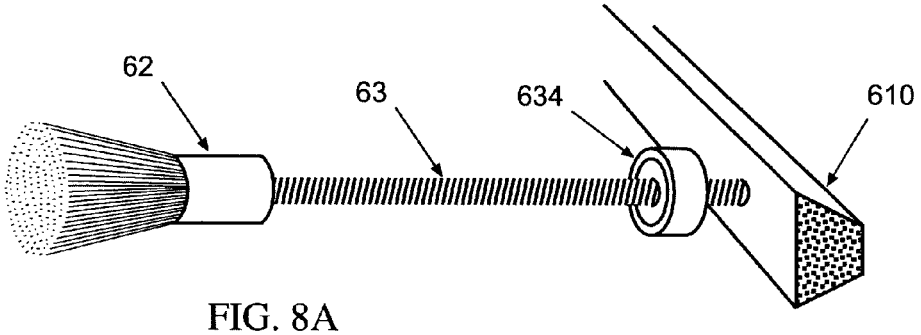
FIGS. 8A, 8B and 8C illustrate various types of cleaning heads and their mounting on the stripe.
Figure 8B:
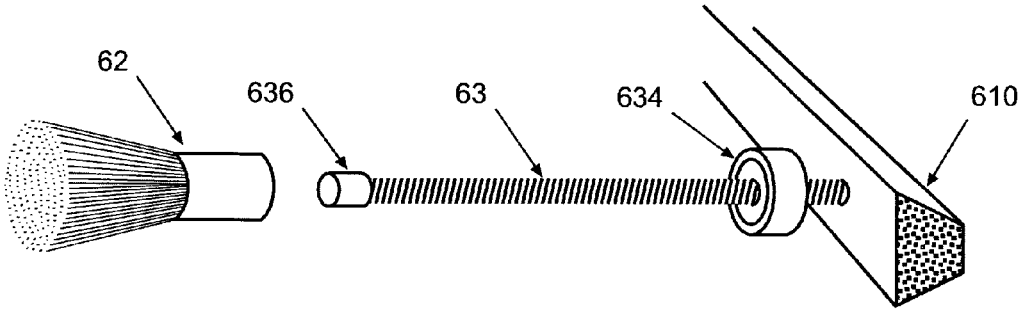
Figure 8B:
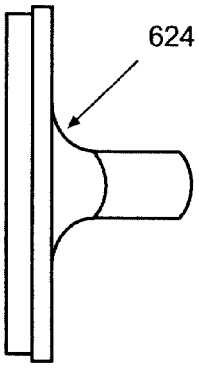
Figure 8C:
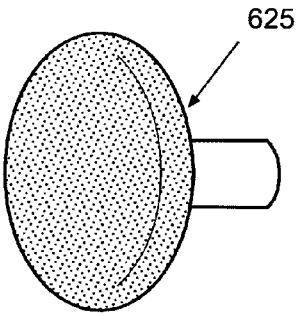

FIGS. 8A, 8B and 8C illustrate various types of cleaning heads and their mounting on the stripe 610 or belt 61.

The cleaning head may include a brush 62, a wiper 624 or a polishing head 625 for example.

Preferably, the cleaning head is dismountable as illustrated, so a belt or stripe may be configured with any type of cleaning means (or a combination thereof) as desired. This achieves a modular, versatile system.

It will be recognized that the foregoing is but one example of an apparatus and method within the scope of the present invention and that various modifications will occur to those skilled in the art upon reading the disclosure set forth hereinbefore.

The invention claimed is:

1. A system for cleaning windows in tall buildings, the system comprising:

a chassis having means for mounting on a suspended platform, a rotating conveyor belt or a group of parallel rotasting stripes mounted on the chassis, wherein the belt is oriented at a slant angle from horizontal axis of the window frames such to maintain horizontal movement of the brushes while the system moves vertically; and brushes mounted on the conveyor belt, wherein each brush is mounted on an extending element made of art elastic material, where said extending element is a spring designed to move in three dimensions connected to the rotating conveyor belt enabling free movement of the brush in any direction, which allows passing ledges and irregularities in vertical or horizontal direction in the surface of the building and around the windows;

wherein the conveyor belt or stripes group is rotating in a generally horizontal direction resulting in horizontal movement of the brushes in relation to the windows.

2. The cleaning system according to claim 1, wherein the system is further comprising: (i) a first roller; (ii) a second roller; and (iii) a motor connected to the chassis for rotating the conveyor belt or stripes group, wherein the conveyor belt or stripes group is mounted on the rollers, and wherein the motor rotates at least one of the rollers.

3. The cleaning system according to claim 1 wherein the conveyor belt or stripes group enables detached from the system for replacing the belt or the stripes enabling to use a belt or stripes with different extenders types and brushes adapted for different jobs, including at least one of: cleaning and polishing.

4. The cleaning system according to claim 1 further including nozzles for spraying a liquid or detergents toward the windows.

5. The cleaning system according to claim 1 wherein the system is further including a control system for coordinating the movements of the parts of the system.

6. The cleaning system according to claim 1 wherein the system is further including a second belts or stripes group, moving in opposite direction from the first belt or stripes group.

7. The cleaning system according to claim 1 wherein the system is further including a plurality of platforms mounted side by side and moving together up and down, to simultaneously clean a larger width of a building surface.

8. The cleaning system according to claim 1 wherein the system is further including support means for the extenders, for maintaining the extenders in a generally horizontal orientation as they move along the support means.

9. The cleaning system according to claim 1 wherein each belt or stripes group are adjusted at an angle of inclination with respect to horizontal axis of the window.

* * * * *